United States Patent [19]

Eisermann

[11] Patent Number: 5,057,830

[45] Date of Patent: Oct. 15, 1991

[54] LOCKING DEVICE OPERATIVE WITH SEQUENCE OF ELECTRIC SIGNALS

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 423,149

[22] Filed: Oct. 18, 1989

[30] Foreign Application Priority Data

Oct. 21, 1988 [DE] Fed. Rep. of Germany ..... 3835913

[51] Int. Cl.[5] ..... E05B 47/00

[52] U.S. Cl. ..... 340/825.31; 70/277

[58] Field of Search ..... 340/825.31, 825.69, 340/825.72; 70/277, 278

[56] References Cited

U.S. PATENT DOCUMENTS 4,802,353 2/1989 Corder et al. ..... 70/277

4,831,374 5/1989 Massel ..... 340/825.31

4,833,465 5/1989 Abend et al. ..... 340/825.31

*Primary Examiner*—Palmer C. Demeo

*Assistant Examiner*—John Guist

*Attorney, Agent, or Firm*—Martin A. Farber

[57] ABSTRACT

A locking device on doors is provided with inner and outer escutcheons (2, 3) and having a lock (5) which is arranged between the two escutcheons to permit actuation from the inside and outside. In order to obtain a substantial advantage by remote inquiry of the locking condition and/or storage of locking conditions which have taken place, the locking device has a simple construction, including at least one switch disk (19, 19*a*) which is entrained upon the actuation of the lock and contact or switch (S1, S2) associated with the switch disk in order to produce electric recording signals concerning an actuation of the lock and/or inside and outside interrogation takes place.

9 Claims, 5 Drawing Sheets

-1-
2
3
4
5
6
7
8
9
10
12
13
19
19a
23
R
X
$S_1$
$S_2$
BOLT
LOCKING
MECHANISM 2
32
S1
31
19
S2
19a
25
R
29
27
30
26
33
28
B

LOCKING DEVICE OPERATIVE WITH SEQUENCE OF ELECTRIC SIGNALS

FIELD AND BACKGROUND OF THE INVENTION

The present invention relates to an electric-motor-driven locking device on doors provided with inner and outer escutcheons (3, 2) and having a lock (5) which is arranged between two escutcheons, and can be actuated form the inside and the outside. An object of the invention is to develop a locking device of this type in simple construction, and wherein advantage in use is obtained making possible remote inquiry as to the locking condition and/or even a storing of locking processes which have taken place.

SUMMARY OF THE INVENTION the foregoing is achieved by features of the invention providing for at least one switch disk (19), 19*a*) which is entrained upon actuation of the lock and a contact or switch (S1, S2) associated with said switch disk for producing electrical recording signals concerning the actuation of the lock.

As a result of this development there is created a locking device the locking condition of which—locked or open—can be indicated at any time at a suitable place. With electrical storage of the signals, for instance in chronological sequence with date and hour—when and from where—from the inside or the outside—locking accomplished over long periods of use can be recorded (and played back).

If both the inner and outer handles have a switch disk associated with them and if both handles turn in the same direction, then the one switch disk is to be left inactive when the other operates, so that an unequivocal evaluation of the signal with respect to inside or outside actuation is obtained. If an electric motor is provided on one of them, then one can also determine from its current pulse the identification of the side which was actuated. The special electric-motor-driven locking device proposed in this connection also results, in the event of the most favorable arrangement of the motor in the escutcheon, which is in any event present, in the considerable advantage that it can be installed in very simple manner, for instance also on doors already equipped with mortise locks. The escutcheon present can be removed; the escutcheon of the invention installed; the crank arm mounted on the escutcheon passes into the lock through the locking-cylinder insertion opening of normal mortise locks; the protruding section of the crank arm engages on the bolt locking mechanism, corresponding to the locking member of the locking cylinder which is otherwise In this manner several doors can, with the most favorable construction, be combined to form a common motor-driven locking device, for instance, in the manner that the supplying of the motor with current is brought about by a remote central place, for instance for the joint opening or locking of a plurality of doors.

On the other hand, the corresponding command unit for supplying the motor with current can also be readily arranged in the escutcheon itself. In this case a completely self-sufficient attachment unit is obtained. The command unit can, in this connection, consist of a key-actuatable locking cylinder in the escutcheon, for instance in the knob of the escutcheon, or preferably of a permutation lock. By setting the permutation lock to the corresponding key combination, the motor receives its current supply, whether in opening or in closing direction. It is, in this connection, advantageous if a battery is also arranged in the escutcheon, in which case one should preferably merely provide an emergency opening function in the event of the unexpected discharging of the battery. By the switch disk on the crank-arm shaft, the operations of the motor or the corresponding operating positions of the motor can be interrogated via the feelers or switches which are controlled by the switch disk. This is advantageous in particular in the case of possible remote control of one or more such locking devices.

If the switch disk has several switching tracks arranged concentrically to each other, then a large number of possible variations result with respect to the interrogation of the switch conditions at the time. The corresponding interrogation can in that case also be coupled with a recording device in order to permit the entire motor lock to operate within its own logic. If the end of the crank arm inside the lock continues into an actuating mandrel which is mounted in the opposite escutcheon, then, in view of the double-sided mounting, there is obtained a greatly stabilized form of construction and also, in the case of a freely rotatable motor, a currentless actuation of the entire lock from the inside of the room. With respect to a lock or an armature in which the locking function is released by electric coupling, then the locking action and/or side on which the action took place can be identified by interrogation of the voltage of the electric coupling and/or of the coupling parts.

BRIEF DESCRIPTION OF THE DRAWINGS

An embodiment of the invention is shown by way of an illustrative example in the attached drawing, in which.

DETAILED DESCRIPTION OF THE PREFERRED EMBODIMENTS

Figure 1:
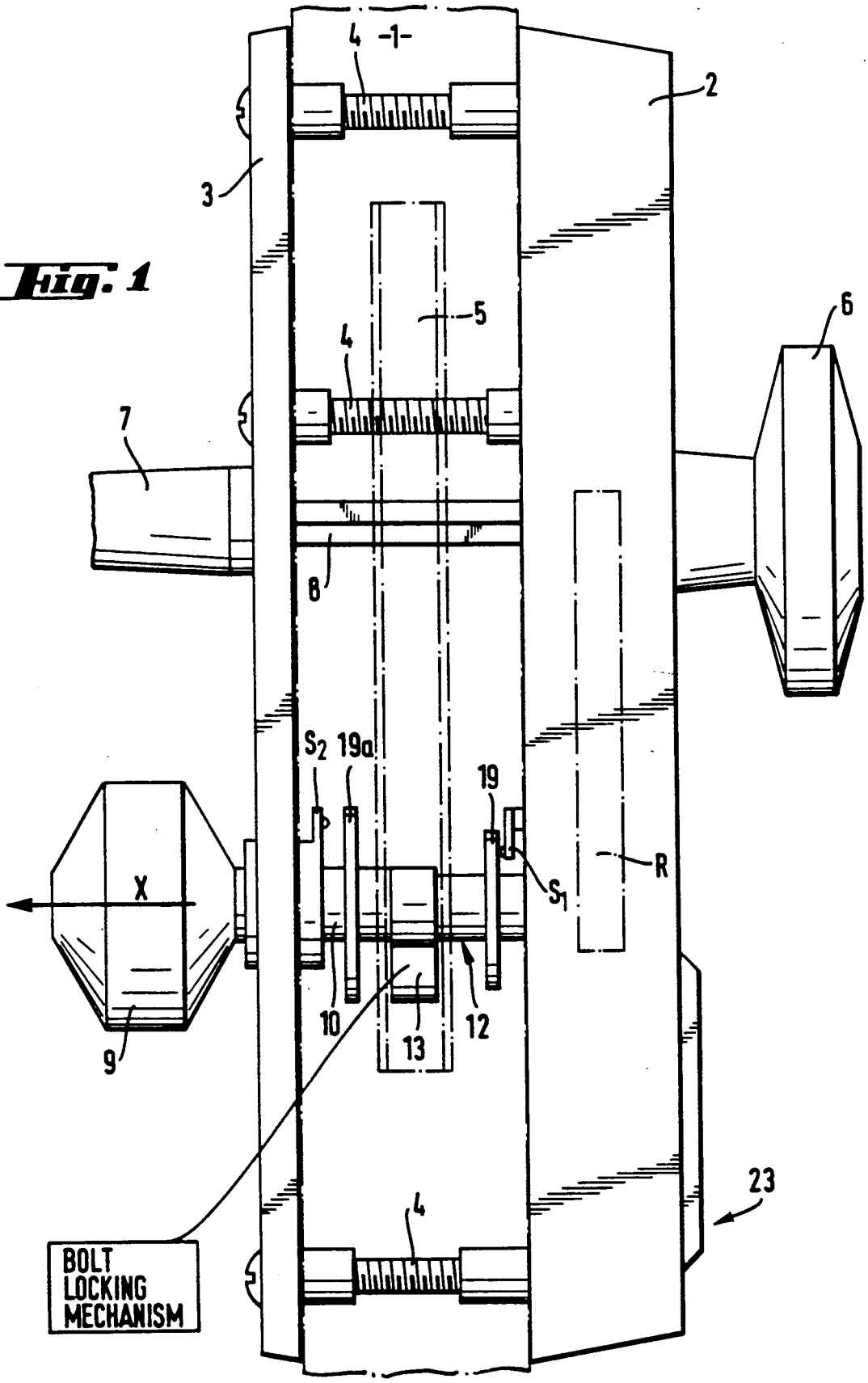
FIG. 1 is a fragmentary side view of the door with the locking device of the first embodiment.

The door 1 is provided with the escutcheons 2 and 3. The escutcheon 2 is seated, for instance outside the room and the escutcheon 3 inside it. Connecting screws 4 pass through the door 1 and a mortise lock 5, not shown in detail. The escutcheon 2 has a outer knob 6. The escutcheon 2 is provided with a pusher 7 which, by the pusher mandrel 8, actuates in known manner a nut of the lock which may possibly also be retractable via the bolt locking mechanism by means of a change lever.

There is also associated with the escutcheon 3 an actuating knob 9 the actuating mandrel 10 of which is mounted in the escutcheon 3. It is aligned with a shaft section 11 of a crank arm 12, a protruding section 13 of which engages on a normal bolt locking mechanism (not shown) of the mortise lock 5, for instance by means of tumblers and multiturn bolt recesses.

In the embodiment according to FIG. 1, the crank arm 12 can be actuated by the outer knob 6 via a belt drive R, for instance after this belt drive R or the like has been actively connected to the crank arm 12 by a command unit 23 such as a number lock.

On the crank arm 12 and on the mandrel 10 there are seated switch disk 19 and switch disk 19*a*, respectively. The former always cooperates with a feeler switch Sl and thus produces an electric signal upon each rotary step. With the switch disk 19a there is associated a feeler/switch S2. It enters into action when the actuating knob 9 is pulled out for actuation in the direction of the arrow x. The switch signal which is then present must therefore be distinguished from that which occurs upon operating the outer knob 6. The signals are preferably stored as a function of time and sorted by side.

Figure 2:
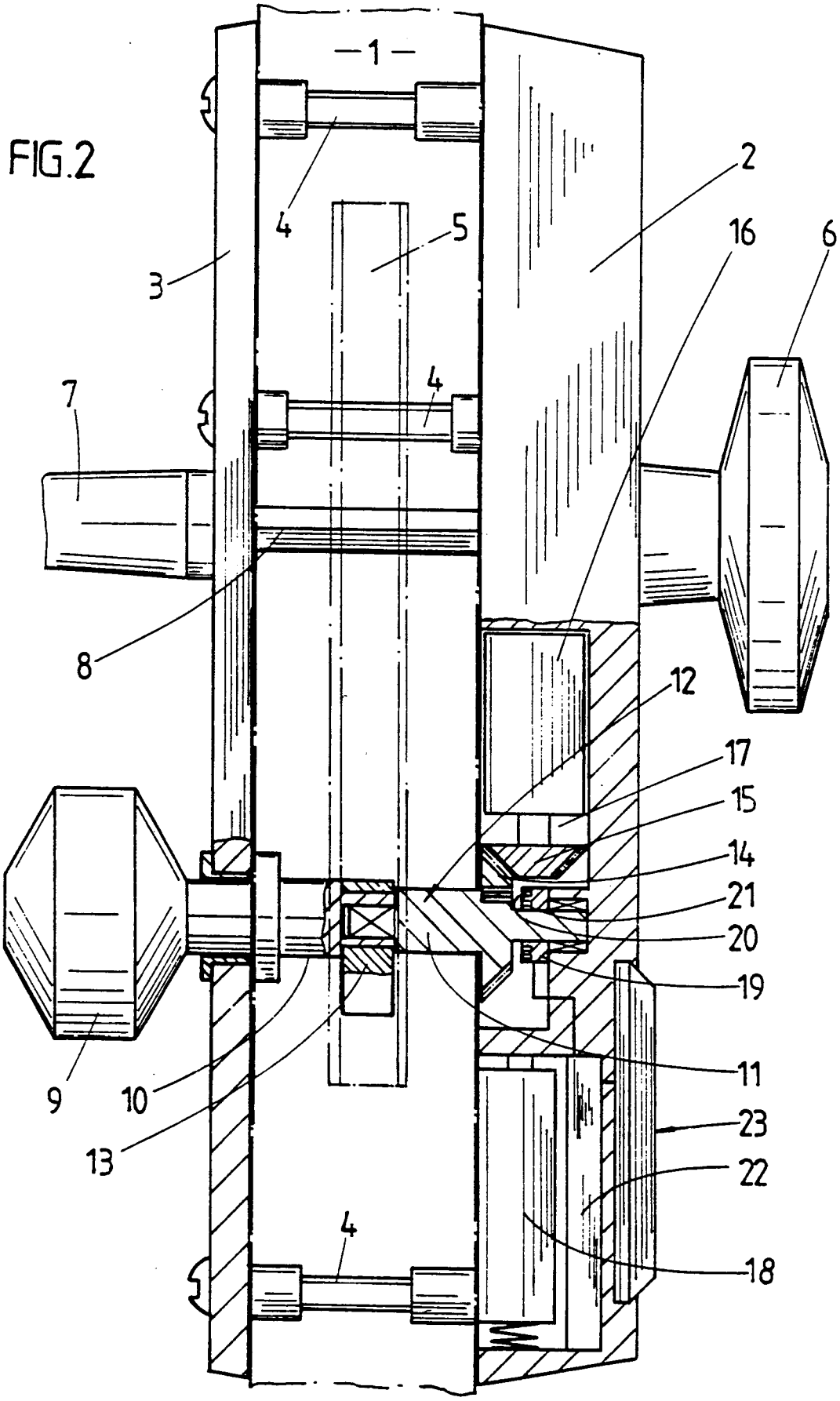
FIG. 2 is the same view, partially in longitudinal section, of a second embodiment.
Figure 3:
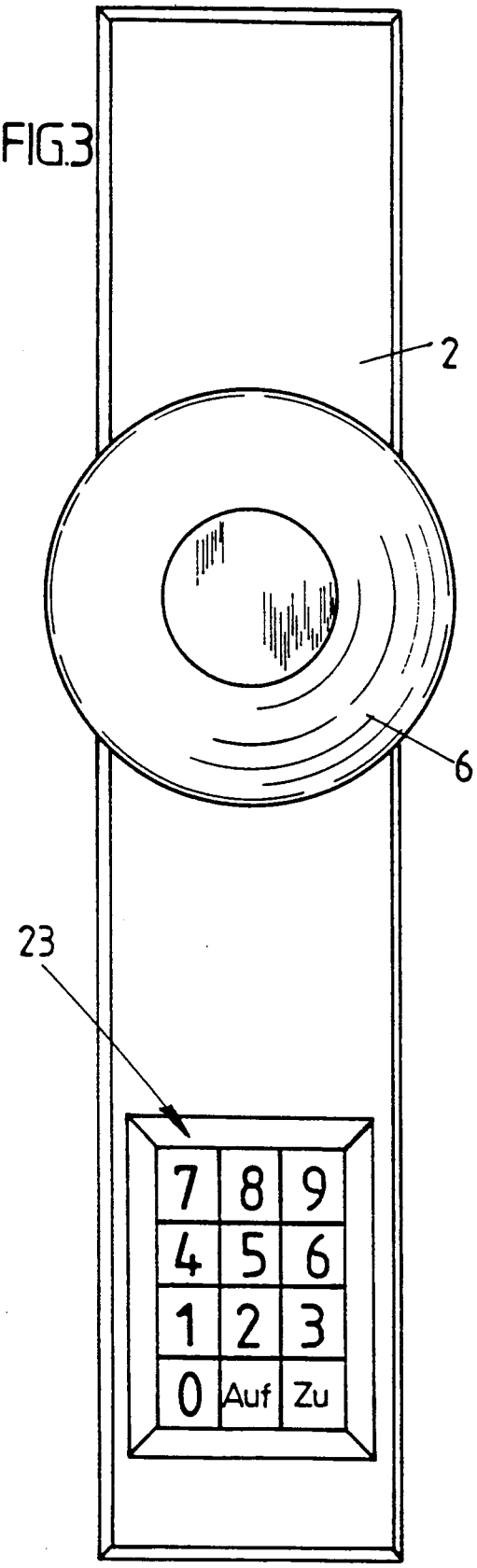
FIG. 3 is a front view of the escutcheon of FIG. 2.
Figure 4:
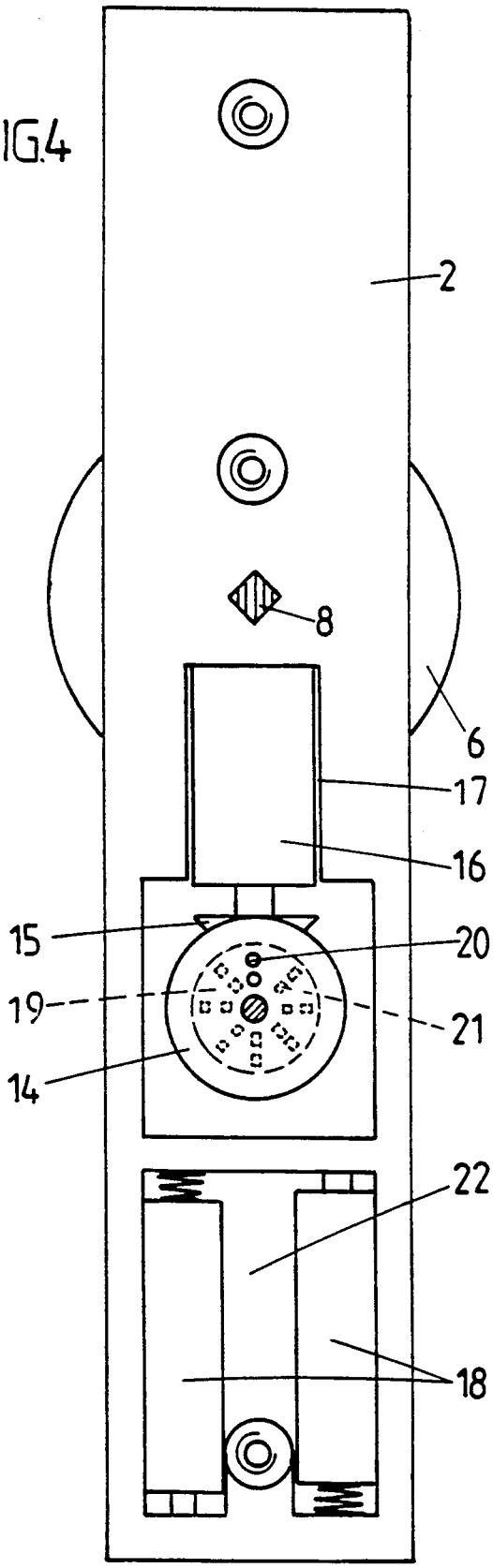
FIG. 4 is a rear view of the escutcheon of FIG. 2.
Figure 5:
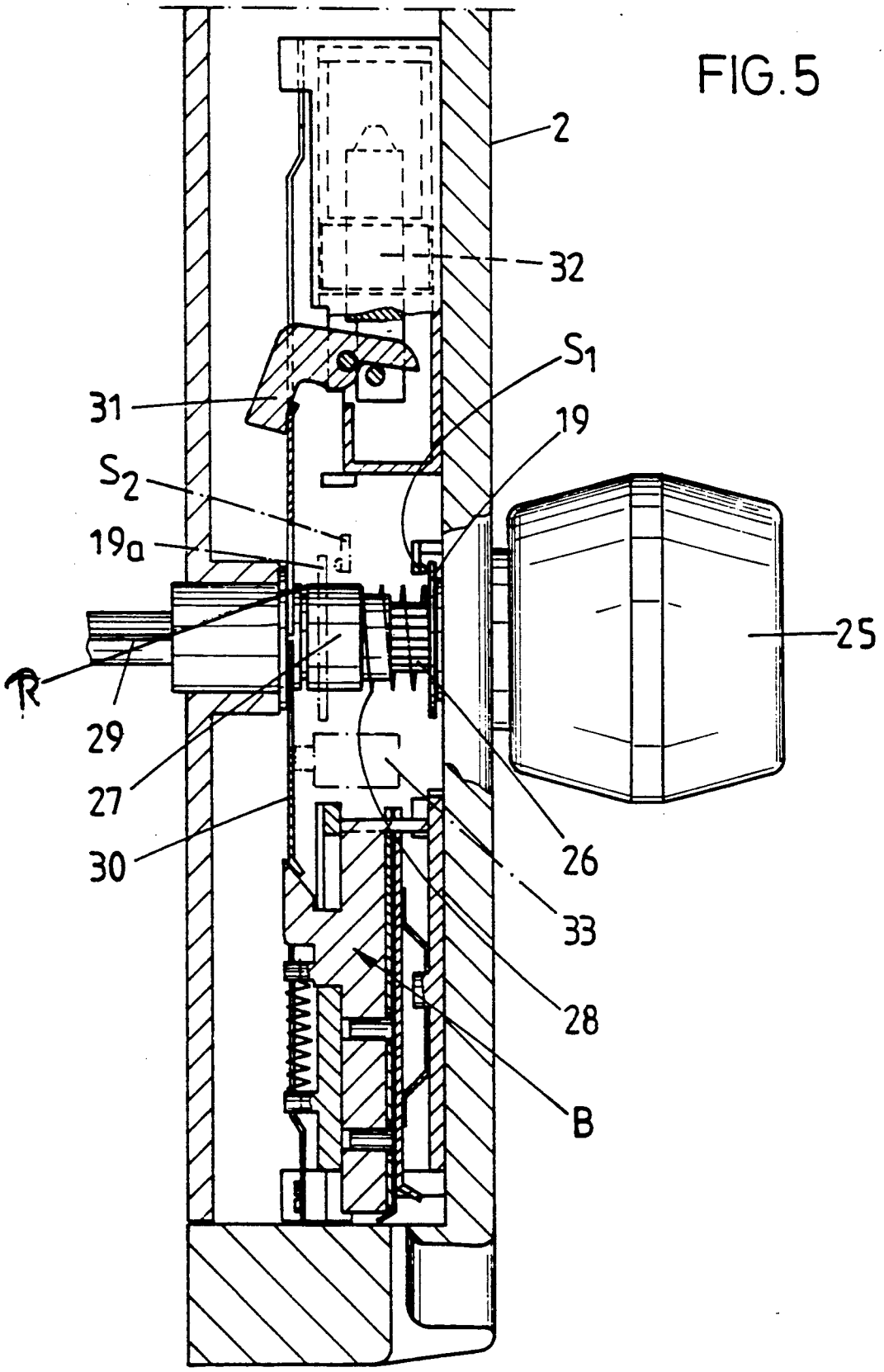
FIG. 5 is a longitudinal section through a further variant.

In the embodiment according to FIGS. 2–4, the crank arm 12 is mounted in the escutcheon 2 and is provided with the bevel gear 14. The latter meshes with the mating bevel gear 15 of an electric motor 16. This electric motor 16 is also arranged in the escutcheon 2, preferably in an opening 17 provided from the rear side of the escutcheon. The direction of rotation of the electric motor is reversible and it receives its current from two batteries 18 which are also arranged in the escutcheon, preferably in a compartment which is provided with a cover which can be opened.

On the shaft of the crank arm 12 there is again seated a switch disk 19. The latter has several switch recesses 20, 21 arranged aligned with each other on different circular radii. Feelers/switches cooperate with said recesses. By means of said recesses they inquire as to the instantaneous angle of rotation of the crank arm 12 in order, for instance, to forward this instantaneous operating condition to a computer/memory 22. The content of the memory can be interrogated externally also in this case. A command unit 23 is also provided in the escutcheon 2 in the form of a push-button permutation lock. By entering the corresponding key combination, including actuation of the "open" or "locked" command push buttons, the corresponding current supply for the motor can be initiated, as a function of the direction. If the switch disk 19 gives off signals, without the motor 16 being under current, then a signal is formed which is part of the actuation of the actuating knob 9; if the switch disk 19 gives off signals while the motor 16 is under current, then these signals are identified as signaling external actuation.

The embodiment of FIG. shows an escutcheon with engageable knob 25. By displacement of a bushing 27 against the action of the spring 28, the mandrel 26 of the knob 25 can be coupled with the pusher mandrel 29 which extends to the lock. This displacement can be effected by a command unit B developed as a magnetic card lock in accordance with European Patent 24 13 23, by means of a leaf spring 30 which can also be moved by a rocker arm 31 by means of the magnet 32. The position of the leaf spring 30 is interrogated by means of a feeler 33.

The switch disks 19 and 19*a* , respectively, are seated on the mandrel 26 and/or—shown in dash-dot line—on the bushing 27, respectively. By means of the switch disk 19 interrogated by the feeler/switch Sl—all actuations of the knob 25 are converted into signals. If it is only desired to convert operational turns—no idle turns of the knob 25 then the interrogation of the engaged position by the feeler 33 is employed. If the switch disk is seated on the bushing 27, then it will enter into action with feeler S2 only by displacement of the bushing. Furthermore, the feeding of current to the coil of the magnet 32 can be tapped off as signal; in this case, the electric switch 33 could be dispensed with. If the leaf spring 30 is made continuous or if it is allowed to engage into the annular groove R of the bushing 27, then the switch 33 can also record movements which come from the magnet 32.

Figure 6:
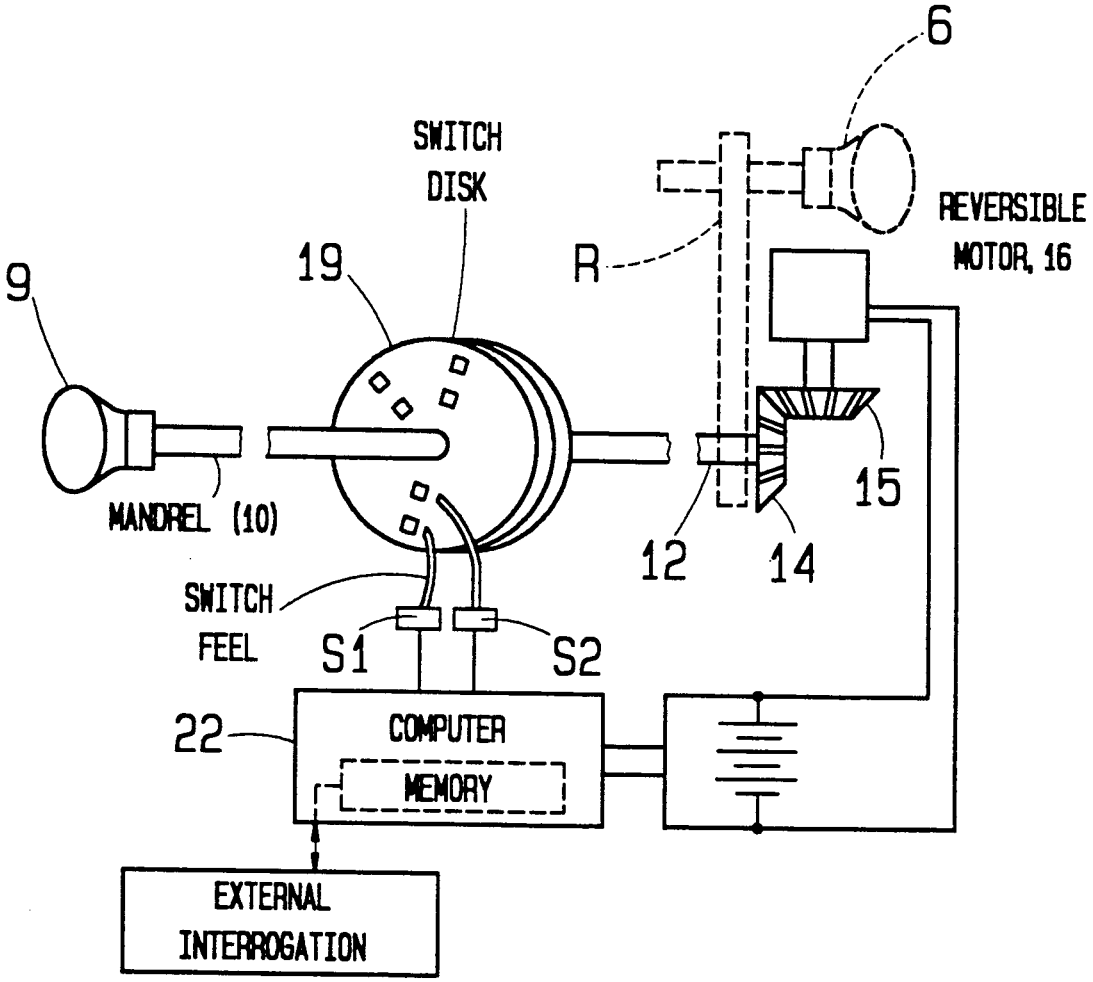
FIG. 6 is a block digram of electrical interconnection of components of the locking device.

FIG. 6 shows in simplified form the interconnection of a switch disk 19 with two switch feelers to a computer. The computer and the motor 16 ar powered from a battery. Rotation of the disk by rotation the mandrel 10, under power of the door knob or the motor, produces a train of current pulses which the computer has been programmed to recognize. Data is stored in the memory.

I claim:

1. A locking device on a door provided with inner and outer escutcheons comprising a locking which is arranged between the two escutcheons and which is actuatable from inside the door and from outside the door;

a rotatable actuating mandrel extending through a first of said escutcheons toward a second of said escutcheons, rotation of the mandrel operating the lock to permit an opening of the door;

a swtich, and at least one switch disk which is entrained with said mandrel to move upon rotation of the mandrel during actuation of the lock, the switch disk having recesses arranged in predetermined locations for engagement with the switch, the recesses engaging sequentially with the switch in response to rotation of the mandrel; and wherein the switch is operatively coupled to a source of electric power and to said switch disk for producing a sequence of electric pulses upon a succession of openings and closings of the switch produced by engagement of the switch with said recesses during movement of the switch disk, th sequence of electric pulses depending on an arrangement of said predetermined locations for constituting electrical recording signals describing activation of the lock.

2. A locking device on a door provided with inner and outer escutcheons comprising a lock which is arranged between the two escutcheon and which is actuatable from inside the door and from outside the door;

a rotatable actuating mandrel extending through a first of said escutcheons toward a second of said escutcheons, rotation of the mandrel operating the lock to permit an opening of the door;

means responsive to actuation of the lock from the inside or the outside of the door for generating two independent electric recording signals describing actuation of the lock, said generating means including switching means with a switch disk entrained with said mandrel to move upon rotation of the mandrel, said switching means outputting a sequence of signals constituting said recording signals upon movement of said disk; and a memory for storing the electric signals in a chronological sequence of actuations of the lock to permit playback of data stored in the memory.

3. A locking device according to claim 1, wherein said lock includes a bolt locking mechanism;

a crank arm shaft which acts on the bolt locking mechanism; and wherein said actuating mandrel extends from one side of the door to the opposite side of the door;

the locking device includes a second switch disk carried by the actuating mandrel, and a second switch;

said first-mentioned switch disk is seated on said crank arm shaft; and said second switch disk is brought into active engagement with said seconds witch by an axial displacement of the actuating mandrel, said displacement occurring upon actuation of the lock.

4. A locking device according to claim 1, wherein a recording signal of said switch designates inside actuation of said lock;

said lock comprises an electric motor disposed in one of said two escutcheons for actuation of the lock; and a recording signal of outside actuation of the lock is obtained by supplying current to said motor during an outside actuation of the lock.

5. A locking device according to claim 1, further comprising a motor, a command unit, a crank arm, and a bolt locking mechanism; and wherein a rear side of the outer escutcheon receives the motor and the command unit;

the command unit controls the motor;

the crank arm is mounted in cantilevered manner to the outer escutcheon and extends into the lock; and a projecting section of the crank arm acts on the bolt locking mechanism.

6. A locking device according to claim 5, wherein the command unit is developed as a permutation lock.

7. A locking device according to claim 5, further comprising a battery arranged in the outer escutcheon for supplying the motor with current.

8. A locking device according to claim 1, further comprising an actuating knob operatively connected to said mandrel, said mandrel being releasably renagable with said lock;

a command unit for engaging said knob via a coupling position with said lock; and wherein the switch disk is seated on the mandrel of the actuating knob; and a coupling position of said actuating knob is interrogated in order to activate the switch disk to supply the recording signals.

9. A locking device according to claim 1, further comprising a second switch disk, a coupling bushing, an actuating knob located on said outside escutcheon, a command unit, and a second switch; and wherein said second switch disk is seat don a movable section of said coupling bushing;

said coupling bushing is brought into locking engagement with said knob by said command unit and connects the knob with said mandrel; and upon a coupling position of the knob with the mandrel, the second switch disk is in active engagement with the second switch.

* * * * *